United States Patent [19]

Good

[11] Patent Number: 4,785,562

[45] Date of Patent: Nov. 22, 1988

[54] MAGNETIC DISPLAY HOLDER

[75] Inventor: Richard R. Good, San Diego, Calif.

[73] Assignee: Good Concepts, Inc., San Diego, Calif.

[21] Appl. No.: 881,694

[22] Filed: Jul. 3, 1986

[51] Int. Cl.[4] ..... G09F 1/10

[52] U.S. Cl. ..... 40/159.1; 40/642

[58] Field of Search ..... 40/10 R, 158 R, 152, 40/158

[56] References Cited

U.S. PATENT DOCUMENTS

| | | | |
|---|---|---|---|
| 1,463,740 | 7/1923 | Gee | 40/10 X |
| 1,506,215 | 8/1924 | Beshgetoor | 40/158 R |
| 1,516,264 | 11/1924 | Bliss | 40/584 |
| 1,624,741 | 4/1927 | Leppke | 40/1.5 |
| 1,845,327 | 2/1932 | Paget | 40/158 R |
| 2,659,169 | 11/1953 | Brennan | 40/1.5 |
| 3,031,799 | 5/1962 | Bradsby | 40/10 A X |
| 3,124,501 | 3/1964 | Wise | 40/10 R |
| 3,187,449 | 6/1965 | Longo | 40/10 R |
| 3,245,165 | 4/1966 | Podoloff | 40/10 X |
| 3,298,124 | 1/1967 | Jahn | 40/158 R |
| 3,698,111 | 10/1972 | Smith | 40/155 |
| 3,789,527 | 2/1974 | Mohr | 40/152 |
| 3,826,026 | 7/1974 | Bevan | 40/10 B |
| 3,886,677 | 6/1975 | Behring et al. | 40/158 R |

*Primary Examiner*—Robert Peshock
*Assistant Examiner*—Wenceslao J. Contreras
*Attorney, Agent, or Firm*—Calif Kip Tervo

[57] ABSTRACT

A display device comprising a frame having a front side, rear side, outer edge, and inner edge; the inner edge surrounding and defining an interior opening and display area. The frame includes magnetic attachment means so that a display piece, such as a child's drawing or photograph or the like, can be retained in a display position between the frame and a metal surface. An exemplary embodiment employs truncated interior corners to accommodate a range of display piece dimensions. In a further precept, ridges on the rear side act as moldings. In another embodiment, the display device comprises a plurality of corner sections.

1 Claim, 1 Drawing Sheet

MAGNETIC DISPLAY HOLDER

BACKGROUND OF THE INVENTION

This invention relates in general to a display device and more specifically involves a magnetically attachable display device and one which particularly accommodates display of various dimensions.

It is desirable to post and display various items. At home particularly, it would be desirable to easily and prominently post and display items such as children's graded school-work or drawings, photographs, or important messages. Conventionally, either such items are posted with pins on a specially-purchased bulletin board or they are posted on a commonly-available metal surface surface, such as a refrigerator, with small magnets.

There are a number of disadvantages to the prior art methods. Full framing is expensive and time consuming. Pinning require a specially-purchased board and puts holes on the posted work. Also notably, the most convenient methods only involve posting of a work and make no provision for framing of the work, for the accentuation of the work or a portion thereof, or for protection of the work.

Therefore it would be desirable to have a display device capable of magnetically attaching and capable of quickly and easily posting and framing a display piece to a metal surface.

It is further desirable that such a display device be capable of accommodating display pieces of different dimensions.

SUMMARY OF THE INVENTION

According to the invention, a display device comprises a frame having a front side, a rear side, an outer edge, and an inner edge. The inner edge surrounds and defines an interior opening thru the frame. The frame is comprised of magnetic material or includes magnets for attaching the frame to a metal surface such that a display work, such as a photograph, sheet of paper, child's drawing, or the like can be retained in a display position between the frame and the metal surface and is accentuated and displayed in the interior opening.

According to a further precept of the invention, the inner edge is generally rectangular with truncated corners which allow the display of works of different dimensions. On the rear side of the frame, ridges act as as moldings for the frame.

In an exemplary embodiment, the frame is comprised of a plurality of corner sections.

Other features and many attendant advantages will become more apparent upon a reading of the following detailed description together with the drawings in which like reference numerals refer to like parts throughout.

DETAILED DESCRIPTION OF THE INVENTION

Figure 1:
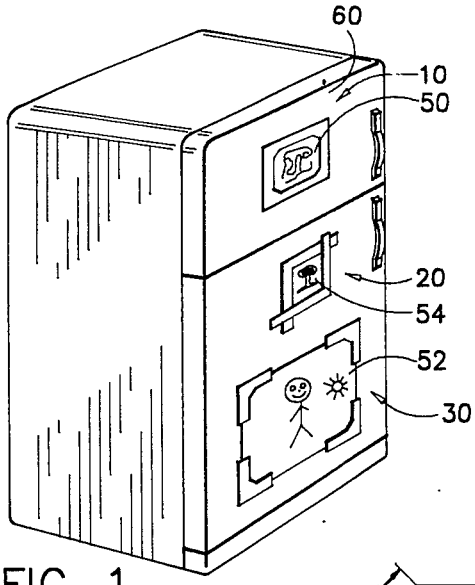
FIG. 1 is a perpsective view of three embodiments of the display device of the present invention attached to the metal surface of a refrigerator.

With reference now to the drawing, and more particularly to FIG. 1 thereof, there are shown three distinctive exemplary embodiments of the display device of the present invention, designated generally as 10, 20, and 30, as they would typically be used to mount and display a display piece, such as a photograph 54, a child's schoolwork 50 or drawing 52, or the like, to a metal surface, such as refrigerator door 60.

Figure 2:
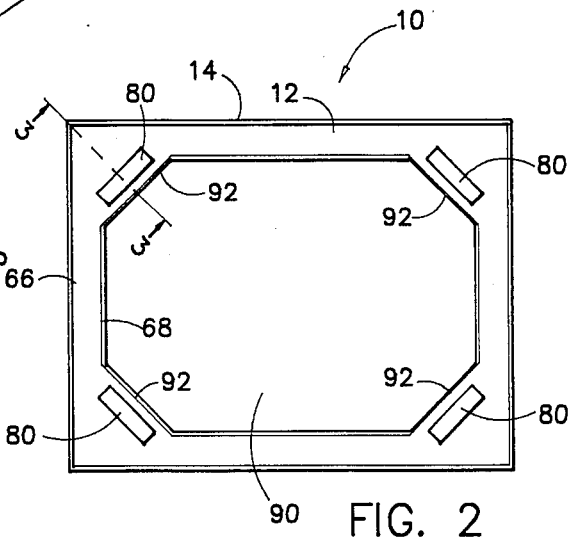
FIG. 2 is a rear plan view of a preferred embodiment of the invention.

FIG. 2 depicts one exemplary embodiment of the display device of the present invention, solid frame 10. Solid frame 10, shown in rear view, comprises a generally rectangular frame 12 having an outer edge 14 and an inner edge 16. Frame 12 may be composed of magnetic material or may be wood, plastic or the like and include a plurality of attached magnets 80. Frame 12 and magnets 80 are preferably of very low profile so that the frame rests as close as possible to a displayed work.

Inside edge 16 surrounds and defines an interior opening 90, surrounded by frame 12, in which a work can be seen and displayed. In the preferred embodiment of FIG. 2, inner edge 16 is generally rectangular with truncated corners in plan view, and the truncated corner portions 92 of frame 12 contain a magnet 80 near the inner edge 16. Magnet 80 in this position more firmly holds the displayed work. Truncated corner portions 92 also allow for the display of works of different sizes. For example, a frame with outside dimensions of nine inches by twelve inches with truncated corners may adequately display works from nine by twelve inches to works of four and and one-half by ten inches in one direction and seven by seven inches in the other directions. These extreme or dimensions in between may be used because the display devices of the present invention may be conveniently utilized in any orientation.

Figure 3:
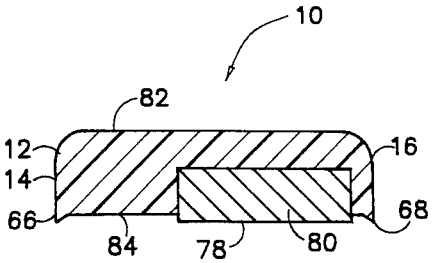
FIG. 3 is a sectional view taken of line 3—3 of FIG. 2.

FIG. 3 is a cross-sectional view taken along line 3—3 of the solid frame embodiment of FIG. 2 and rotated so that front side 82 is on the top. On rear side 84, magnet 80 is embedded in and fixedly attached to frame 12 in any suitable manner. Inside edge rearward projection, ridge 68, projects slightly rearwardly from inner edge 16 to approximatley the depth of the rear surface 78 of magnet 80. Preferably, ridge 68 is resilient. Ridge 68 serves as a molding and assures that the display frame extends to the displayed work and therefore there is no shadow or dark line around the displayed work created by the frame. Outside edge rearward projection, molding 66, projects slightly rearward from outer edge 14. Molding 66 is similar to ridge 68 in function and and may have the same structure.

Solid frame 10 is shown in use in FIG. 1 at the top of the refrigerator door displaying a child's schoolwork.

With reference now to FIGS. 4*a*, 4*b*, 4*c* and 4*d* there is shown alternate exemplary embodiment of the display device of the present invention, segmented frame 30. Segmented frame 30 is comprised of a plurality of corner sections, FIGS. 4*a*, 4*b*, 4*c*, 4*d*, each of which is similar in structure to the corners of solid frame 10 described above. Each corner section has a left leg 32 and right leg 34 with an included angle 36 of less than one hundred and eighty degrees therebetween. The work to be displayed is displayed in the display area delimited by the legs of the corner sections and the visual extension of the legs.

Segmented frame 30 may be used to post and display a work of almost any dimensions. Segmented frame 30 is shown in use in FIG. 1 toward the bottom of the refrigerator door displaying a rather large drawing 52.

Figure 5:
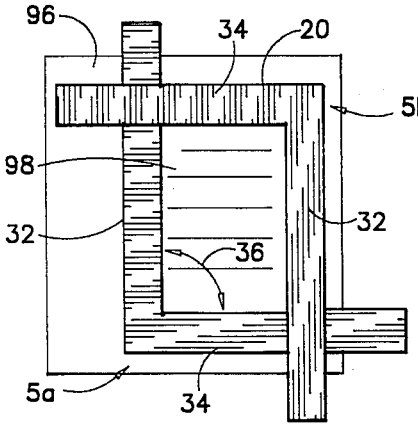
FIG. 5 is a rear plan view of still another embodiment of the invention.
Figure 4B:
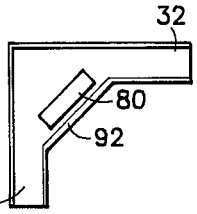
FIGS. 4*a*, 4*b*, 4*c* and 4*d*, combined, illustrate a is front view of an alternate embodiment of the invention.
Figure 4A:
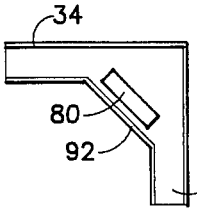
Figure 4C:
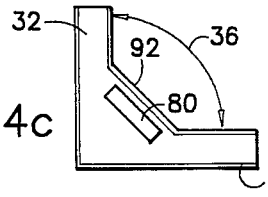
Figure 4D:
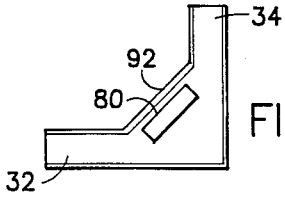

Turning now to FIG. 5, there is shown an alternate and prefered embodiment of a segmented display frame, segmented and flexible frame 20, which is shown posting a magazine page 96 and displaying a portion 98 of that page. Flexible frame 20 is comprised of a plurality of corner sections 5*a*, 5*b*, each having a left leg 32 and right leg 34 with a included angle 36 of less than one hundred and eighty degrees between them. Legs 32,34 are of equal length and are very flexible in the front to rear direction. This flexibility enables the leg of one corner section to lie over the top of the leg of another corner section while still maintaining its rear surface in contact or close proximity with the metal surface. This aids in retaining a displayed work. Flexible frame 20 is particularly useful in displaying a portion of a larger posted work. It is also particularly suitable for construction out of flexible magnetic material.

Flexible frame 20 is also shown on perspective view in use in FIG. 1 displaying a photogrpah.

From the foregoing description, it is seen that the present invention provides an extremely efficient and reliable manner of posting works on a metal surface and in framing and accentuating the entire work or a portion thereof to call attention to it and to present it in an aesthetically pleasing manner.

Although particular embodiments of the invention have been illustrated and described, and various changes may be made in the form, construction, and arrangement of the parts herein, without sacrificing any of its advantages, it is to be understood that all matter herein is to be interpreted as illustrative and not in any limiting sense and it is intended to cover in the appended claims such changes and modifications as come within the true spirit and scope of the invention.

I claim:

1. A display device comprising:

a frame having a front side, rear side, an outer edge, and an inner edge; said inner edge surrounding and defining an interior opening thru said frame; said frame including magnetic attachment means for attaching said frame to a metal surface such that a display piece, such as a photograph, sheet of paper, child's drawing or the like, can be retained in a display position between said frame and a metal surface whereby the display piece in displayed within said interior opening; and wherein:

said inner edge is, in front view, generally rectangular with truncated corner positions, and said truncated corner portions of said frame contain magnets.

* * * * *